US010264944B2

(12) United States Patent
Dabal

(10) Patent No.: US 10,264,944 B2
(45) Date of Patent: Apr. 23, 2019

(54) LIGHT SOURCE FOR A DISHWASHER

(71) Applicant: Whirlpool Corporation, Benton Harbor, MI (US)

(72) Inventor: Michal Dabal, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/682,928

(22) Filed: Aug. 22, 2017

(65) Prior Publication Data

US 2019/0059684 A1 Feb. 28, 2019

(51) Int. Cl.
*A47L 15/00* (2006.01)
*A47L 15/42* (2006.01)

(52) U.S. Cl.
CPC ..... *A47L 15/0084* (2013.01); *A47L 15/4246* (2013.01)

(58) Field of Classification Search
CPC ..... A47L 15/26; A47L 15/36; A47L 15/0084; A47L 15/4246; A47L 15/4274; A47L 15/4293; A47L 15/4295; A47L 15/50; A47L 15/502; A47L 15/507
See application file for complete search history.

(56) References Cited

U.S. PATENT DOCUMENTS

| | | | | |
|---|---|---|---|---|
| 8,382,304 | B2 | 2/2013 | Wegener et al. | |
| 9,445,706 | B2 | 9/2016 | Kangas et al. | |
| 2014/0338708 | A1 | 11/2014 | Boyd et al. | |
| 2015/0201823 | A1* | 7/2015 | Poojary | A47L 15/428 134/172 |
| 2015/0208897 | A1* | 7/2015 | Kangas | A47L 15/4219 134/113 |

FOREIGN PATENT DOCUMENTS

EP 2596737 B1 5/2015

* cited by examiner

*Primary Examiner* — David G Cormier
(74) *Attorney, Agent, or Firm* — McGarry Bair PC

(57) ABSTRACT

A dishwasher can include a chassis, a tub, and a dishrack moveable into and out of the tub. A rail assembly mounting the dishrack to the tub can include a slidable rail and at least one support housing secured to the tub for supporting the slidable rail. The dishwasher can also include at least one light source for illuminating a portion of the tub.

6 Claims, 7 Drawing Sheets

LIGHT SOURCE FOR A DISHWASHER

BACKGROUND

Contemporary automatic dishwashers for use in a typical household include a tub, at least one rack or basket for supporting soiled dishes within the tub, and a door for opening and closing the tub. Dishwashers can also include at least one light source for illuminating the tub and improving visibility during loading or unloading.

Traditionally, light sources for dishwashers are mounted directly to the tub, which can necessitate the use of a mounting aperture in the tub to receive mounting hardware for the light source. It can be beneficial to position the light source within the tub to provide as much illumination as possible while minimizing the number of mounting apertures used for assembly.

BRIEF DESCRIPTION

In one aspect, a dishwasher includes a chassis, a tub at least partially defining a treating chamber having an access opening, a dishrack moveable into and out of the treating chamber, a door pivotally mounted to the chassis for selectively opening/closing the access opening, and a rail assembly mounting the dishrack to the tub. The rail assembly includes a slidable rail for supporting the dishrack, at least one support housing secured to the tub supporting the slidable rail, and at least one light source secured to the support housing for illuminating a portion of the tub.

In another aspect, a dishwasher includes a chassis, a tub at least partially defining a treating chamber having an access opening, a door pivotally mounted to the chassis for selectively opening/closing the access opening, a support housing located in the upper part of the tub comprising a base portion, and at least one light source secured to the base portion to illuminate the tub.

DESCRIPTION OF EMBODIMENTS

Figure 1:
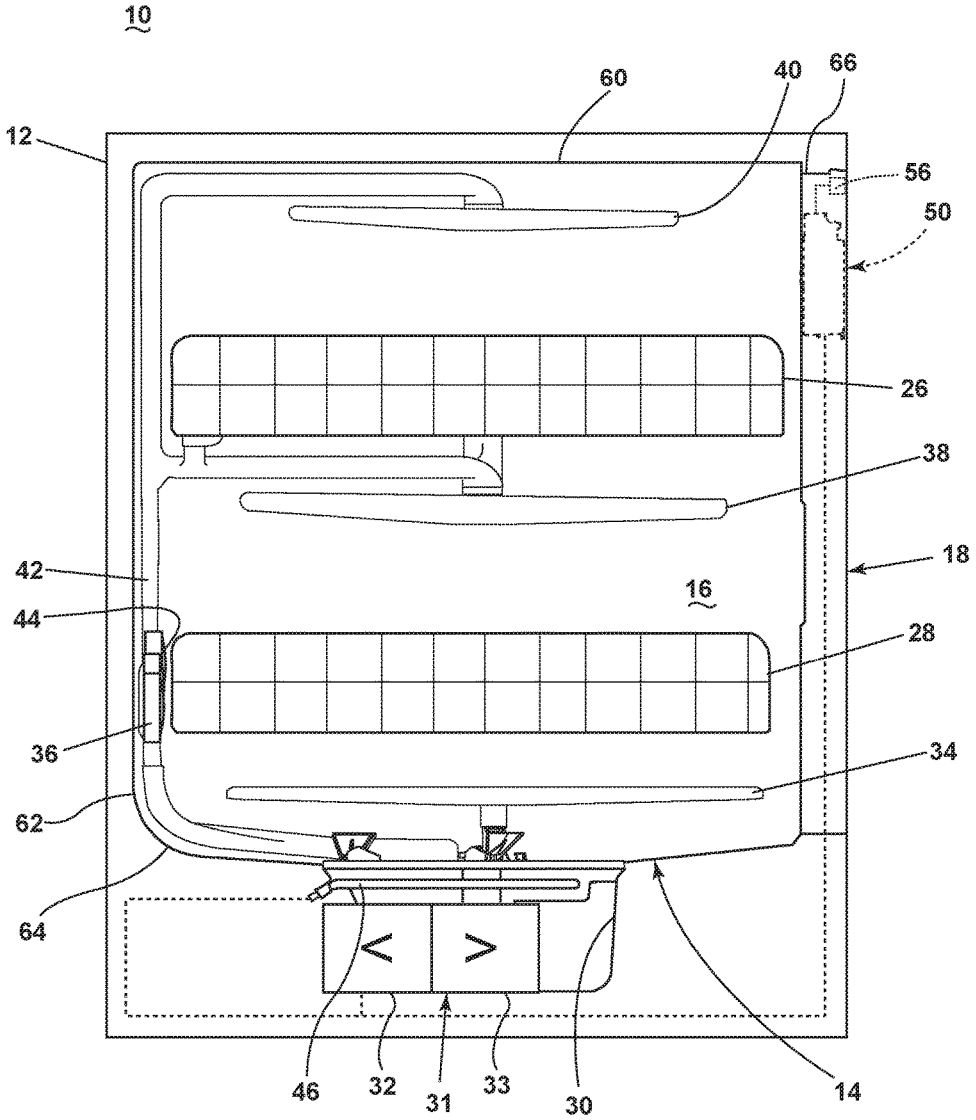
FIG. 1 is a schematic, cross-sectional view of a dishwasher according to various aspects described herein.

Aspects described herein are directed to a lighting source for the interior of a dishwasher. In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware. While not shown in FIG. 1, additional dish holders such as a silverware basket on the interior of the door assembly 18 or a third level rack above the upper rack 24 can be provided.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30. A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
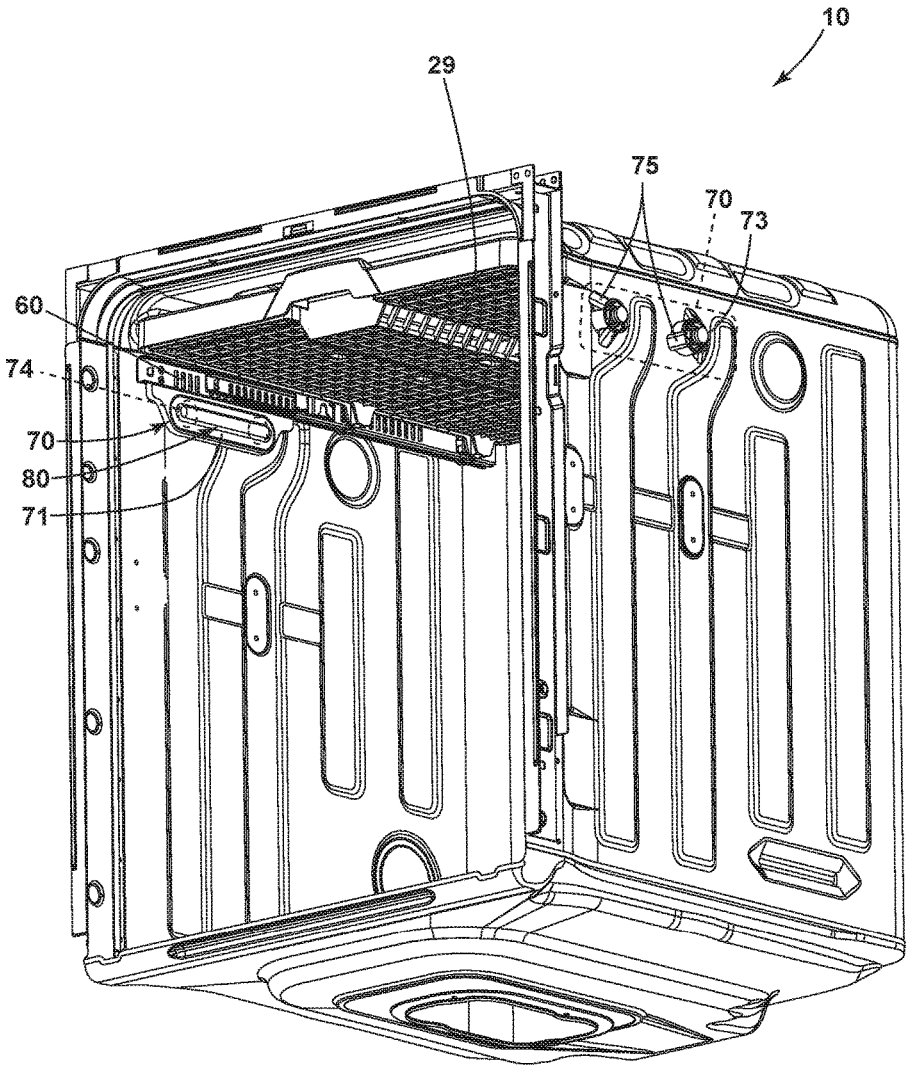
FIG. 2 illustrates a light source which can be utilized in the dishwasher of FIG. 1.

Turning to FIG. 2, the dishwasher 10 can include a rack, illustrated as a third rack 29 positioned above the upper dish rack 26 (FIG. 1) and supported by a rail assembly 60 on each side of the third rack 29. The rail assembly 60 can include at least one slidable rail 62 to allow the third rack 29 to be slidably moved in and out of the treating chamber 16. Although illustrated as supporting the third rack 29, it will be understood that the rail assembly 60 can be used to support any rack within the dishwasher 10.

The rail assembly 60 can also include a support housing 70 which can be integrally form with or coupled to, and located below, the rail 62 to provide support for the rail 62. The support housing 70 can include a base portion 71 which can be secured to the chassis 12 by mounting hardware such as bolts 73 extending through mounting apertures 74 in the chassis 12 and secured with appropriate hardware such as wingnuts 75. Two bolts 73 are illustrated as mounting the support housing 70 to the dishwasher 10, and it will be appreciated that any number of bolts 73, or any other suitable hardware, can be utilized for securing the support housing 70.

A light source 80 can also be included in the rail assembly 60 to illuminate a portion of the treating chamber 16. The light source 80 can be positioned within the base portion 71 as shown. It is contemplated that the light source 80 can be a separate component from, and coupled to, the base portion 71. The light source 80 can also be integrally formed with the base portion 71; in such a case, the rail assembly 60 and base portion 71 can form a single component that can be mounted within the dishwasher 10.

Figure 3:
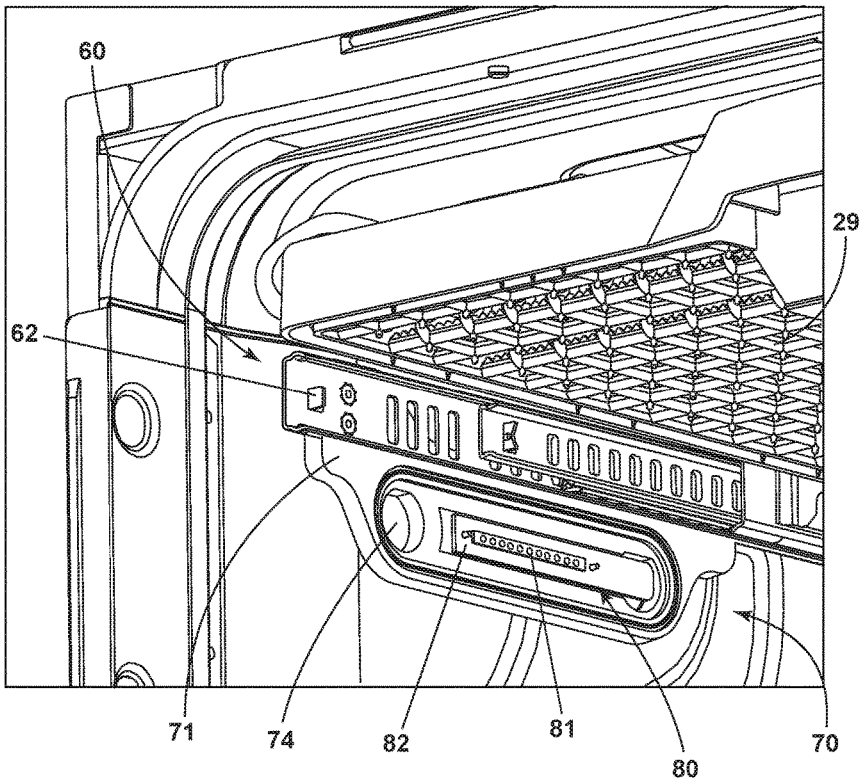
FIG. 3 illustrates the light source of FIG. 3.

Referring now to FIG. 3, it can be seen that the base portion 71 of the support housing 70 can be coupled to the rail 62. In non-limiting examples, the base portion 71 and rail 62 can be coupled using hardware such as bolts or screws, or by welding, or the base portion 71 can also be formed integrally with the rail 62.

The light source 80 can further include a set of lights 81, illustrated as an array of light-emitting diodes (LEDs), and a printed circuit board (PCB) 82 to which the lights 81 can be connected or powered. The lights 81 can be of any desired shape or profile, and can also be positioned to direct light in any desired direction. In a non-limiting example, some of the lights 81 can be directed upward, illuminating an upper portion of the treating chamber 16, while some of the lights 81 are directed downward to illuminate a lower portion of the treating chamber 16. Furthermore, while illustrated as LEDs the lights 81 can include any desired lighting element, including fluorescent or incandescent sources, and can also be battery-operated or wired into the dishwasher 10.

It is further contemplated that the controller 50 (FIG. 1) can control the lights 81 to operate only at pre-selected times. In non-limiting examples, the lights 81 can operate only when the door assembly 18 is opened, or the lights 81 can be powered on with a steadily increasing brightness instead of a sudden change, or the lights 81 can be powered off by steadily dimming in brightness instead of suddenly switching off. In another example where the lights 81 include color-changing capabilities, the controller 50 can also change the color of the lights 81 to form any desired color scheme within the treating chamber 16. It can be appreciated that the controller 50 can control the lights 81 in other examples in the spirit of the present disclosure, such as blinking or flashing.

Figure 4:
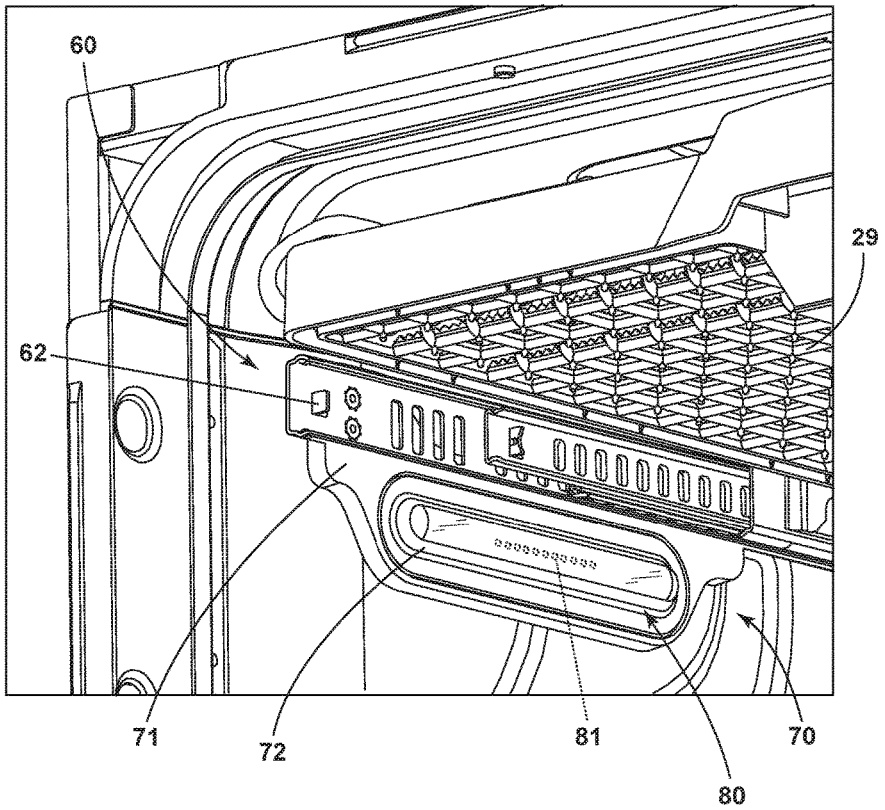
FIG. 4 illustrates the light source of FIG. 4 including a cover.

FIG. 4 illustrates that a transparent cover 83 can be connected to the base portion 71, covering the lights 81 and the mounting apertures 74. The transparent cover 83 can be formed from a waterproof material and comprises a waterproof seal, and in this manner the lights 81, PCB 82, and mounting apertures 74 can be protected from undesired contact with water or moisture inside the treating chamber 16. It is also contemplated that the lights 81 can also include a waterproof casing or shell (not illustrated) to provide additional protection for internal components within the lights 81.

In operation, the third rack 29 can slide into or out of the treating chamber 16 along the rails 62, and the light source 80 positioned beneath the rails 62 can illuminate the treating chamber 16 and any dishes contained inside. When the door assembly 18 is opened, the controller 50 can switch on the lights 81, including with a gradual increase in brightness up to the desired intensity. When the door assembly 18 is closed, the controller 50 can gradually dim the lights 81 to switch them off. In another example, the lights 81 can be suddenly increased or decreased in brightness without gradual dimming or brightening. Furthermore, as described above the lights 81 can blink, flash, or change color to signal a message or provide aesthetic interest within the treating chamber 16, in non-limiting examples.

Figure 5:
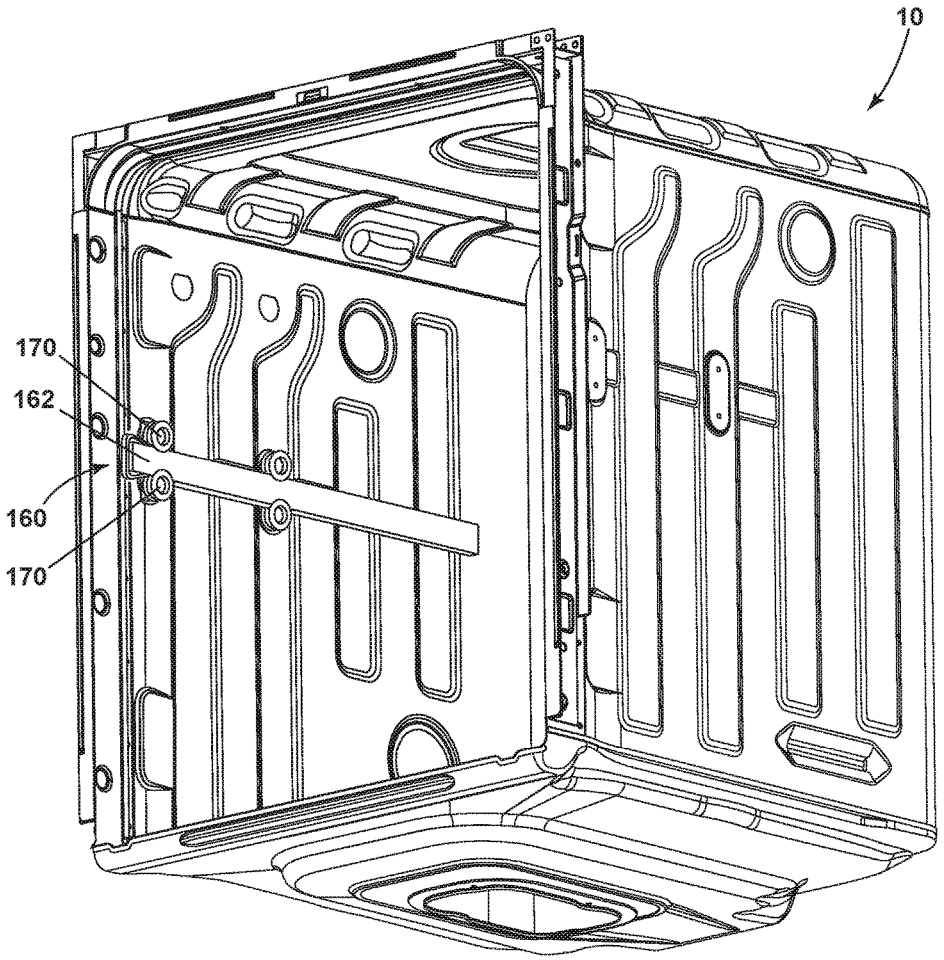
FIG. 5 illustrates a light source which can be utilized in the dishwasher of FIG. 1.

Turning to FIG. 5, another rail assembly 160 is illustrated which can be utilized in the dishwasher 10. The rail assembly 160 is similar to the rail assembly 60, therefore, like parts will be identified with like numerals increased by 100, with it being understood that the description of the like parts of the rail assembly 60 applies to the rail assembly 160, unless otherwise noted.

The rail assembly 160 can include a rail 162 and at least one support housing 170, illustrated as a wheel support housing. The rail 162 is illustrated in a position to support the upper dish rack 26 (FIG. 1); however, it will be appreciated that the rail assembly 160 can be used for any rack in the dishwasher 10.

Figure 6:
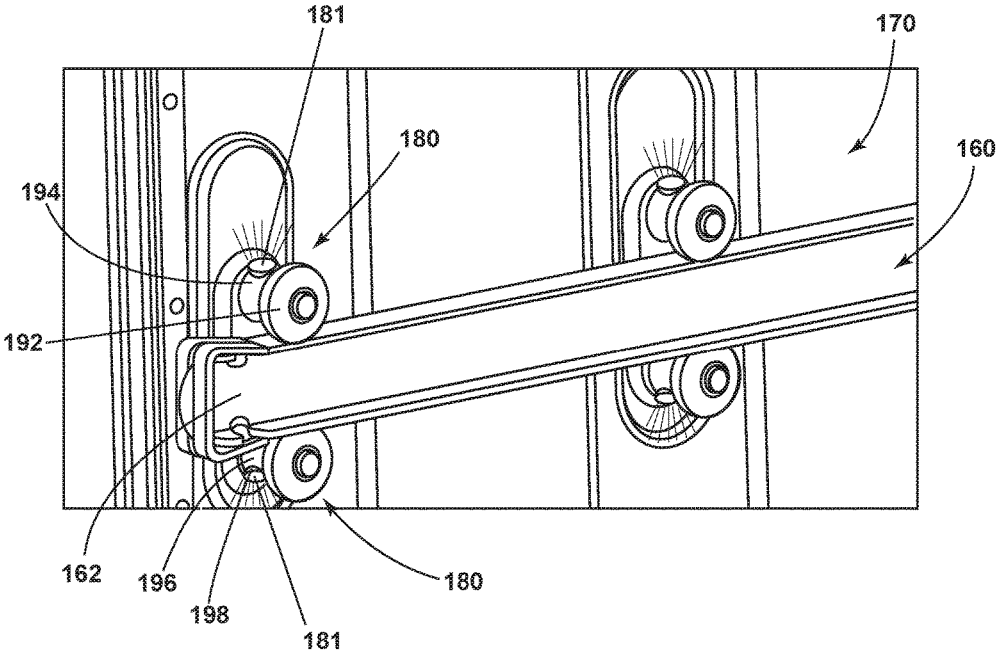
FIG. 6 illustrates the light source of FIG. 5 in a mounted position.

FIG. 6 illustrates the rail assembly 160 in further detail. The support housing 170 can include an upper wheel support 192 with an upper mounting aperture 194, as well as a lower wheel support 196 with a lower mounting aperture 198. A light source 180 can include a light 181 such as an LED mounted within the upper and lower mounting apertures 194, 198 as shown. It is contemplated that lights 181 mounted in the upper mounting apertures 194 can be directed to illuminate an upper portion of the treating chamber 16, while lights 181 mounted in the lower mounting apertures 198 can illuminate a lower portion of the treating chamber 16. Other directions and combinations are contemplated for use with the lights 181 to illuminate desired portions of the treating chamber 16. Furthermore, the controller 50 can control the timing or brightness level of the lights 181 based on opening or closing of the door assembly 18 as described above.

Figure 7:
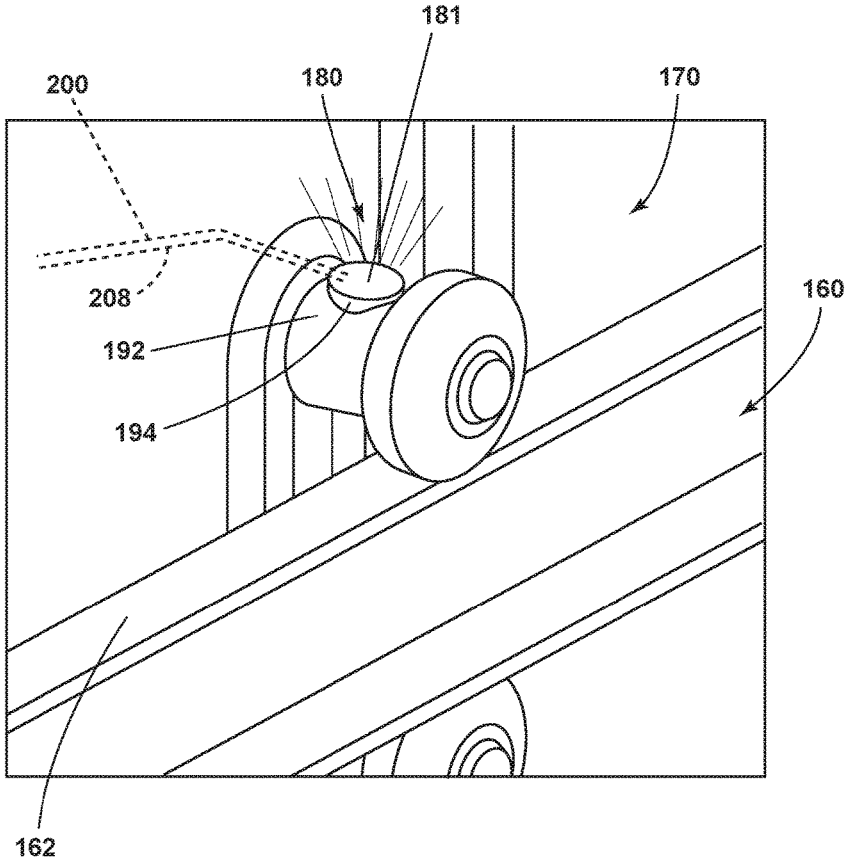
FIG. 7 illustrates a wiring option for the light source of FIG. 6.

Referring now to FIG. 7, one example is illustrated where a set of wires 200 in the dishwasher 10 can be used to power or control the lights 181. It is contemplated that the upper wheel support 192 and upper mounting aperture 194 can include sufficient space into which the wires can be threaded and connected to the lights 181. The wires 200 are illustrated running through the upper wheel support 192 and along the chassis 12. It should be understood that the wires 200 can be part of, or connected to, other electrical wiring (not illustrated) within the dishwasher 10.

It is also contemplated that a transparent waterproof cover (not illustrated) can be fitted over the lights 181 and mounting apertures 194, 198 to prevent water from contacting the lights 181. Furthermore, the lights 181 can be formed with a waterproof casing or shell (not illustrated) to protect internal components of the lights 181 from moisture; either or both of the transparent cover and waterproof casing can be used in the light source 180.

In operation, a rack such as the upper dish rack 26 can slide into or out of the treating chamber 16, and the lights 181 can illuminate the treating chamber 16 or any dishes contained inside. When the door assembly 18 is opened, the controller 50 can turn on the lights 181, including with a gradual increase in brightness up to the desired intensity. When the door assembly 18 is closed, the controller 50 can gradually dim the lights 181 to switch them off. In another example, the lights 181 can be suddenly increased or decreased in brightness without gradual dimming or brightening. Furthermore, as described above the lights 181 can blink, flash, or change color to signal a message or provide aesthetic interest within the treating chamber 16, in non-limiting examples.

Aspects of the present disclosure provide for a variety of benefits. It can be appreciated that coupling the light source to the rail assembly, and utilizing the pre-existing mounting apertures for the rail assembly, can reduce the number of mounting apertures formed in the chassis 12. This can provide for a reduction in potential fluid leaks during operation of the dishwasher, as well as a reduction in complexity when assembling the dishwasher.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:
- a chassis;
- a tub at least partially defining a treating chamber having an access opening;
- a dishrack moveable into and out of the treating chamber;
- a door pivotally mounted to the chassis for selectively opening/closing the access opening; and
- a rail assembly mounting the dishrack to the tub, the rail assembly comprising:
  - a slidable rail for supporting the dishrack;
  - a support housing secured to the tub for supporting the slidable rail;
  - at least one light source secured to the support housing for illuminating a portion of the tub; and
  - a mounting aperture in the support housing for securing the support housing to the tub;
- wherein the at least one light source is located in the mounting aperture.

2. The dishwasher of claim 1 wherein the at least one light source is dimmable.

3. The dishwasher of claim 1 wherein the support housing comprises an upper wheel support and a lower wheel support spaced from the upper wheel support.

4. The dishwasher of claim 3 further comprising an upper mounting aperture in the upper wheel support and a lower mounting aperture in the lower wheel support for securing the support housing to the tub.

5. The dishwasher of claim 4 wherein one of the at least one light source is located in the upper mounting aperture and another of the at least one light source is located in the lower mounting aperture.

6. The dishwasher of claim 1 wherein the at least one light source is a light emitting diode.

* * * * *